US006102398A

United States Patent [19]

Kolleth

[11] Patent Number: 6,102,398

[45] Date of Patent: Aug. 15, 2000

[54] QUESTION AND ANSWER BOARD GAME

[75] Inventor: Hans Peter Kolleth, 53 Callister Crescent, Theodore Act 2905, Australia

[73] Assignees: Anthony Kolleth, Gilmore Act; Hans Kolleth; Sofia Kolleth, both of Hackett Act; Hans Peter Kolleth, Theodore Act; Brian White, Gilmore Act; Dirk Navara, Burra Creek, all of Australia

[21] Appl. No.: 09/148,897

[22] Filed: Sep. 8, 1998

[30] Foreign Application Priority Data

Sep. 9, 1997 [AU] Australia ..... O9073

[51] Int. Cl.[7] ..... A63F 3/04

[52] U.S. Cl. ..... 273/252; 273/254; 273/431

[58] Field of Search ..... 273/254, 253, 273/251, 250, 249, 236, 242, 243, 429–432

[56] References Cited

U.S. PATENT DOCUMENTS

| | | | |
|---|---|---|---|
| 4,049,276 | 9/1977 | Hole | 273/254 |
| 4,052,071 | 10/1977 | Siegfried | 273/254 |
| 4,736,954 | 4/1988 | Haney et al. | 273/236 |
| 4,923,198 | 5/1990 | Diaz | 273/254 |
| 4,988,108 | 1/1991 | Shepard | 273/254 |
| 5,009,430 | 4/1991 | Yuhasz | 273/255 |
| 5,085,439 | 2/1992 | Lott | 273/236 |
| 5,415,411 | 5/1995 | Peterson | 273/237 |

FOREIGN PATENT DOCUMENTS

| | | | |
|---|---|---|---|
| 2205254 | 12/1988 | United Kingdom | 273/254 |
| 2211750 | 7/1989 | United Kingdom | 273/254 |
| 2219744 | 12/1989 | United Kingdom | 273/254 |
| 2272838 | 6/1994 | United Kingdom . | |
| 2292894 | 3/1996 | United Kingdom . | |

*Primary Examiner*—Benjamin H. Layno
*Attorney, Agent, or Firm*—Dykema Gossett

[57] ABSTRACT

A game including a game board which has a map and a path around which players may progress. The map has a grid references and the game is played by players progressing around the path and when the marker lands on an appropriate position, the player has the chance of answering a question. The questions are contained on a series of cards and the answers are provided with either the question or the answer including a grid reference position on the map. Progress around the path is at least partly determined by whether a player answers a question correctly.

6 Claims, 6 Drawing Sheets

50

| | | | | |
|---|---|---|---|---|
| 1. | Pinpoint | Woodstock Rock Festival | 1. | I23 |
| 2. | Pinpoint | The last remaining area where a mexican grizzly bear could be found before extinction | 2. | R8, R9 |
| 3. | Pinpoint | Where did the U.S. have its worst Nuclear Power Station disaster | 3. | J23 |
| 4. | Refer P21 | Why did this state introduce slavery in 1794 | 4. | Forced upon them by 5th Carlma |
| 5. | Refer Q13 | Name the capital of this state | 5. | Austin |
| 6. | Refer K28 | Name this body of water | 6. | Atlantic ocean |

50

| | | | | |
|---|---|---|---|---|
| 1. | Refer R22 | In which year did the Black Wolf become extinct in this state | 1. | 1917 |
| 2. | Refer Map | How many people died to within the 100,000 from influenza in 1918-19 in North America | 2. | 1,037,685 |
| 3. | Refer A10 | Name this lake | 3. | Cree |
| 4. | Pinpoint | The world's worst airship disaster | 4. | J24 |
| 5. | Pinpoint | Where the last major battle of the American war of independance took place | 5. | K23 |
| 6. | Pinpoint | The first hamburger sold in 1901 | 6. | I24 |

50

| | | | | |
|---|---|---|---|---|
| 1. | Refer H23 | What is the name of the Indian Confederacy formed in surrounding areas in 1570 | 1. | League of the five nations |
| 2. | Pinpoint | The area where the snub nosed sucker fish once lived | 2. | I3 |
| 3. | Pinpoint | Punta Caxinas | 3. | Z20 |
| 4. | Pinpoint | Wyoming Peak | 4. | J8 |
| 5. | Pinpoint | Monterey Bay | 5. | L2 |
| 6. | Pinpoint | Anza Borrego Desert Park | 6. | O4 |

*Fig. 6.*

QUESTION AND ANSWER BOARD GAME

TECHNICAL FIELD

This invention relates to a game.

The invention has particular but not exclusive application to games which are educational. However it will be appreciated that the game may also serve numerous other purposes such as, for example, a recreational purpose or a promotional purpose.

BACKGROUND OF INVENTION

Board games in which a player throws a dice and progresses around a board are well known, as are board games involving answering questions listed on cards selected in accordance with the throw of the dice.

SUMMARY OF INVENTION

The present invention aims to provide an alternative to known board games.

This invention in one aspect resides broadly in a game including:

game board having player progress means;

location mapping means;

positional reference means for providing positional references for locating positions on the location mapping means, and question means comprising a plurality of questions, each question or the answer thereto including a reference to a positional reference of a location on the location mapping means;

wherein a player's progress around the player progress means is at least partly determined by whether the player answers a question correctly.

As used herein the expression "game board" is to be given a broad meaning and includes all articles on which a game can be played. Thus the expression is not limited to a board per se, and includes paper and other flexible material such as cloth, as well as an appropriately patterned computer screen version of a game board.

The positional reference means may be any of the various means by which the position of an article can be indicated or determined. Thus the positional reference means could for example be a set of cartesian or polar coordinates. It is preferred that the positional reference means includes grid reference means.

The location mapping means can be any representation of an area or article by means of which a portion of or position in the area or on the article can be located. Thus the location mapping means can be a drawing, sketch or a photograph. However it is preferred that the location mapping means includes a plurality of maps of respective geographic areas. Examples of maps are street maps of suburbs, maps of local regions, maps of each Australian state, maps of major countries, maps of world regions etc. In a preferred embodiment the plurality of maps are interchangeably positionable on the game board.

The location mapping means may include names of locations printed on the maps, or alternatively the location mapping means may be a map without any indication thereon of location or place names.

The question means could for example be a book containing the questions or a series of books or a series of sheets. Alternatively the question means could be a suitably encoded compact disc. However it is preferred that the question means includes a set of question cards, each card in the set having printed thereon a question.

The question cards in the set may be a series of questions on a range of themes or topics, or may be general knowledge questions. In one preferred embodiment the question means includes a plurality of sets of question cards, each set including questions relating to a given topic or theme. Examples of themes are sport, politics, music, history, religion, current affairs, art, drama etc.

A plurality of sets of question cards may be provided for each map in location mapping means which comprises a plurality of maps of respective geographic areas.

In one preferred embodiment the player progress means includes question indicating means for indicating that a player can select a question card from a set thereof for answering by the player.

In another aspect this invention resides broadly in a method of teaching a plurality of learners, the method including:

providing a game board having player progress means;

providing location mapping means;

providing positional reference means for providing positional references for locating positions on the location mapping means;

providing question means comprising a plurality of questions, each question or the answer thereto including a reference to a positional reference of a location on the location mapping means, and playing a game wherein the learners are the players, a player's progress around the player progress means being at least partly determined by whether the player answers a question correctly.

It will be appreciated that the game and teaching method of this invention are suitable for use with a computer. Accordingly in a further aspect this invention resides broadly in a data processing system for playing a game or teaching a plurality of learners, the data processing system including:

a central processing unit;

display means;

game board storage means for storing data representative of a game board having player progress means for display by the display means;

location mapping storage means for storing location mapping means;

positional reference means for providing positional references for locating positions on the location mapping means;

question storage means for storing question means comprising a plurality of questions, each question or the answer thereto including a reference to a positional reference of a location on the location mapping means, and program means for controlling operation of the data processing system whereby a player's progress around the player progress means is at least partly determined by whether the player answers a question correctly.

It will also be appreciated that the game and method of this invention are suitable for promoting a business having branches or outlets located at a plurality of locations. Accordingly in a further aspect this invention resides broadly in a method of promoting a business located at a plurality of locations, the method including:

providing a game board having player progress means;

providing location mapping means on which are indicated the locations of the business;

providing positional reference means for providing positional references for locating positions on the location mapping means;

providing question means comprising a plurality of questions, each question or the answer thereto including a reference to a positional reference of a location on the location mapping means and wherein at least some of the questions relate to the business, and playing a game wherein a player's progress around the player progress means is at least partly determined by whether the player answers a question correctly.

DESCRIPTION OF DRAWINGS

In order that this invention may be more easily understood and put into practical effect, reference will now be made to the accompanying drawings which illustrate a preferred embodiment of the invention, wherein:

FIG. 6 illustrates sample questions which can be used with the board game of FIG. 5.

DESCRIPTION OF PREFERRED EMBODIMENT OF INVENTION

Figure 1:
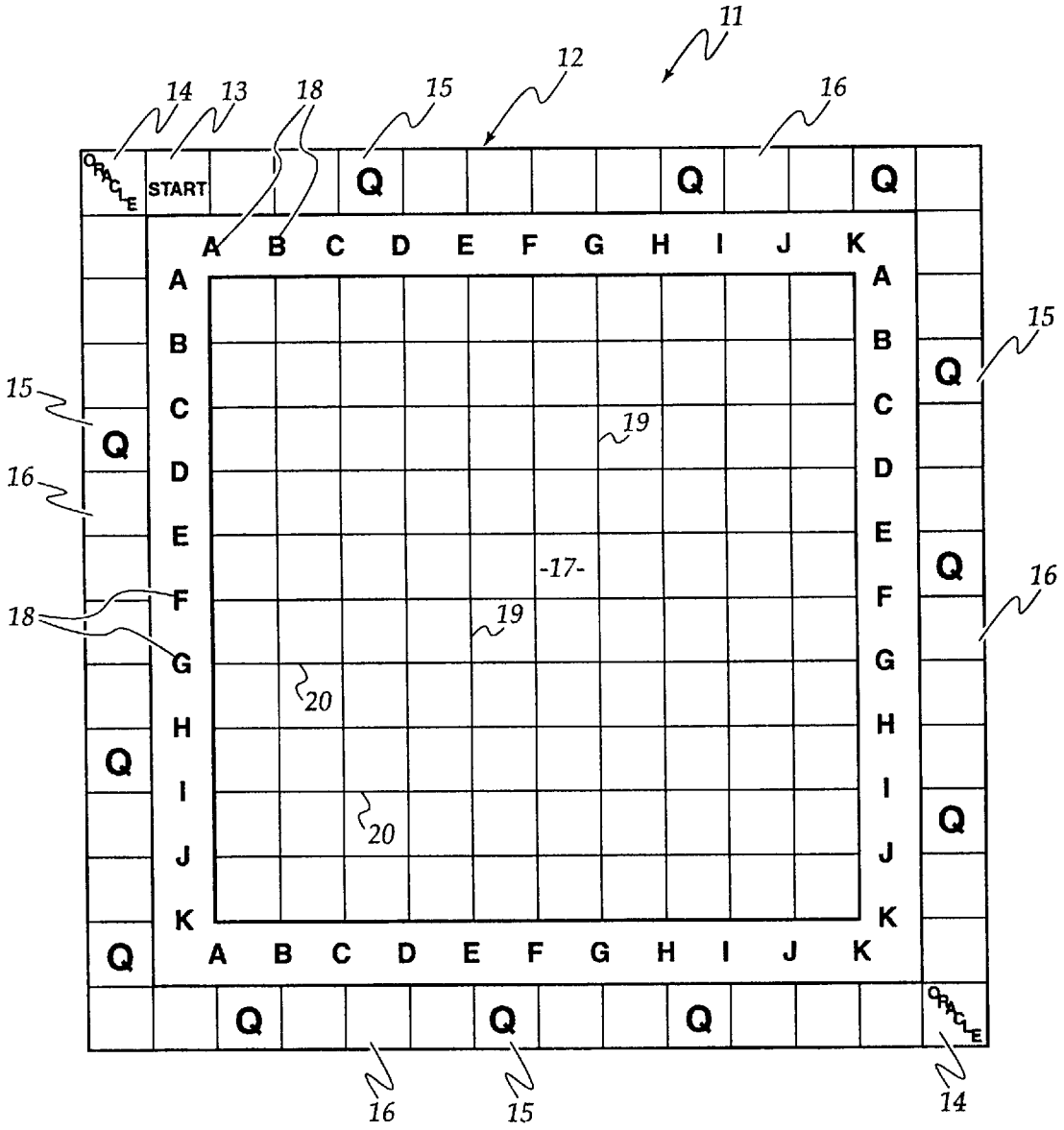
FIG. 1 illustrates one embodiment of a game board for use with the invention.
Figure 2:
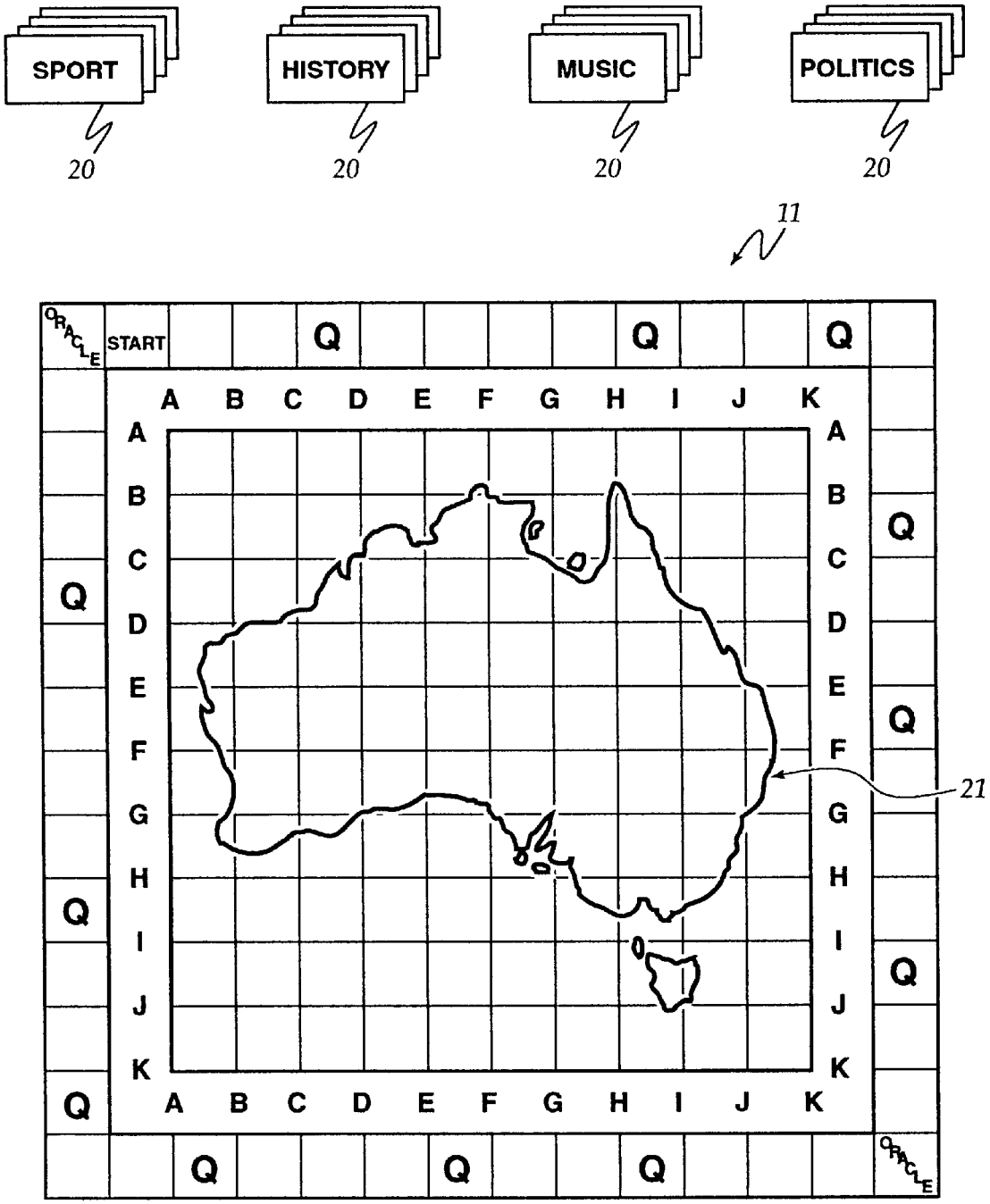
FIG. 2 illustrates the game board of FIG. 1 with a map positioned therein and with four sets of question cards.

As can be seen in FIG. 1, a games board 11 has an outer periphery constituting a player progress means 12 along which a player token progresses as an indication of the stage to which each player has progressed in the game. The player progress means has a plurality of spaces including a start space 13, a pair of finishing or ORACLE spaces 14, a plurality of question indicating spaces 15 where a player landing on one of these spaces has the opportunity to answer a question selected (as seen in FIG. 2) from one of a plurality of sets of questions based on a chosen theme such as those illustrated ie Sport, History, Music or Politics. A series of other spaces 16 can include penalty and bonus provisions for players landing on these spaces—examples are Free Question spaces, Move Forward spaces, Move Backward spaces, Bonus Points spaces etc.

Game board 11 also has a grid reference system 17 comprising a plurality of alphabetical grid references 18 and a clear plastic sheet carrying grid lines 19 and 20. The plastic sheet is affixed at one side (not shown) to the game board and constitutes a flap under which a map 21 can be located as seen in FIG. 2.

The position of various locations on a map is given in standard grid reference format by first giving the longitudinal coordinate followed by the latitudinal coordinate, with the position of a particular location falling between coordinates being estimated on a scale from 0 to 9. Thus in FIG. 3 the position of Redcliffe is given by positional or grid reference C7B0, Brisbane is at C5C2 and Ipswich is at B3C7.

Different sets of question cards 20 are available for each map included in the set of maps which constitute the location mapping means of the invention.

Each question in a set of questions for a given map, or the answer to each question, includes reference to a grid reference of a location on the map.

Examples of such questions for given maps and given themes or topics are as follows:

For a map of Victoria in which the grid reference of Melbourne is G3B8.

Sports Q: At what location is a horse race conducted on the first Tuesday in November?

Sports A: G3B8

Politics Q: What Australian Prime Minister entered parliament as member for a seaside electorate at G3B8?

Politics A: Bob Hawke

For a map of Germany in which the grid reference of Dresden is A7H3 and that of Leipzig is K1C4

History Q: At what location was the allied fire bombing raid which completely destroyed the famous medieval section of a city during World War 2?

History A: A7H3

Music Q: Who was the Cantor at K1C4?

Music A: Johann Sebastian Bach

Figure 3:
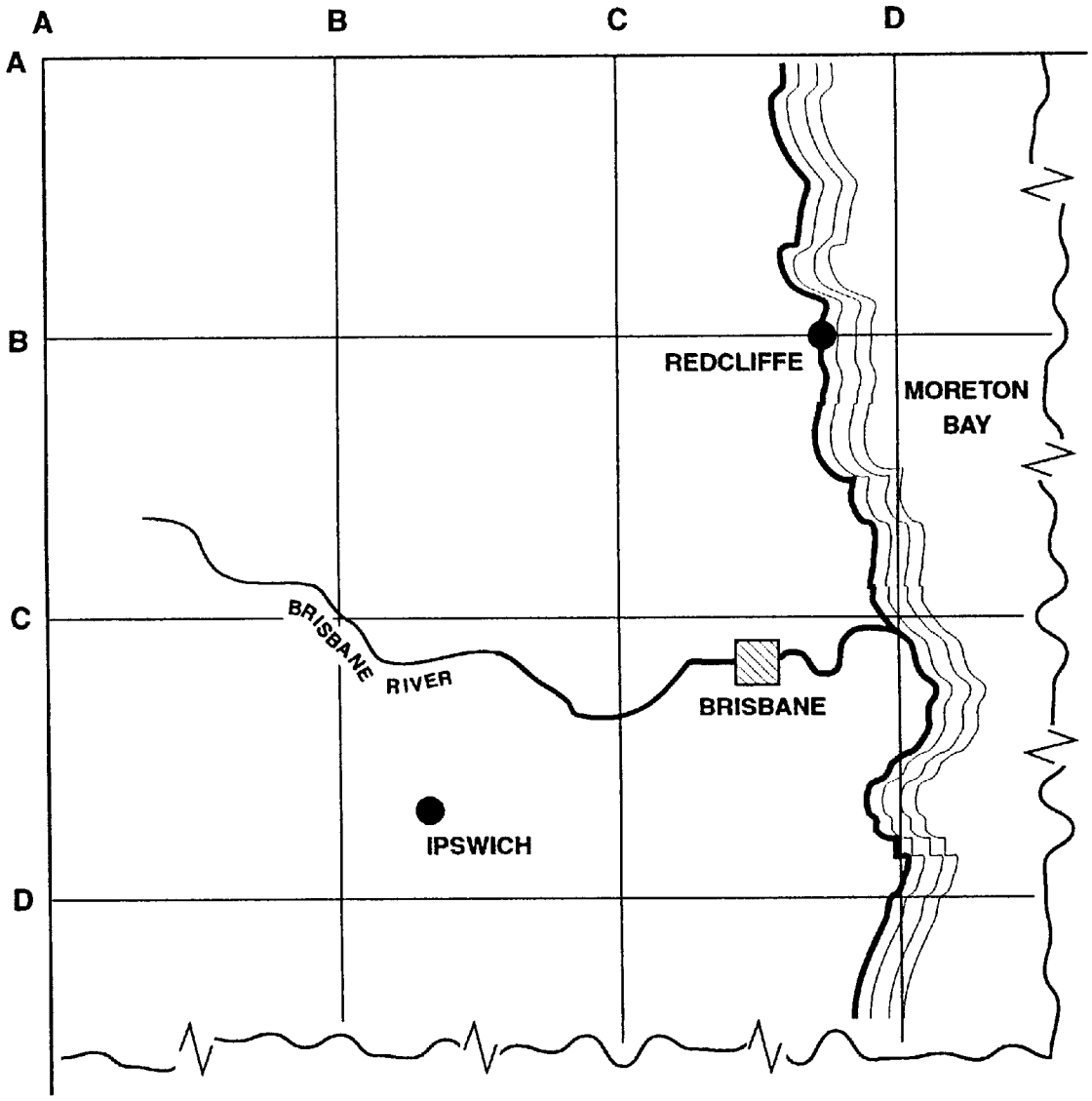
FIG. 3 illustrates a grid reference system overlaid on a map to explain how locations on the map can be identified.

In use, the game illustrated in FIGS. 1 to 3 is played by the players selecting tokens (not shown) and commencing play by throwing dice with the tokens moving the number of spaces thrown by the dice. Players whose token lands on a question indicating space 15 can choose a theme or topic, take a question card from the bottom of the selected card set 20 and attempt to answer the question on the card, the correct answer being given on the reverse side of the card. The card is then placed on the top of the card set.

If the player answers correctly, that player's question score is increased by two. If the answer is incorrect, the player's question score is decreased by one. Play proceeds with players taking penalties or bonuses in accordance with the non-question spaces on which their token lands in accordance with their throw of the dice.

If a player lands on an ORACLE space they have the option of selecting a question from the ORACLE set of questions which are general knowledge questions of a higher standard (or optionally special topic questions of a higher standard) and which carry five points for a correct answer without any penalty for an incorrect answer.

The winner of the game, and entitled to be called the Oracle, is the first person who lands on an ORACLE space with an accumulation of 50 or more points and correctly answers the ORACLE question. If the answer is incorrect, that player must continue playing until their token again lands on an ORACLE space.

It will be appreciated that game can be in played in a number of ways. Thus for example the embodiment illustrated and described above can have many variations. Thus the winner of the game can be the first person to land on an ORACLE space having successfully answered a given number of questions. Alternatively, the winner can be the first person to complete a given number of circuits of the board.

Other variations include penalties if questions have been answered incorrectly—such penalty could be a reduction in the number of questions answered correctly or having to move backward a given number of spaces. Each question card can include a number of questions of varying standard of difficulty with each providing a variable number of points depending on the standard of difficulty, a player having to select the difficulty standard before looking at the questions.

Figure 5:
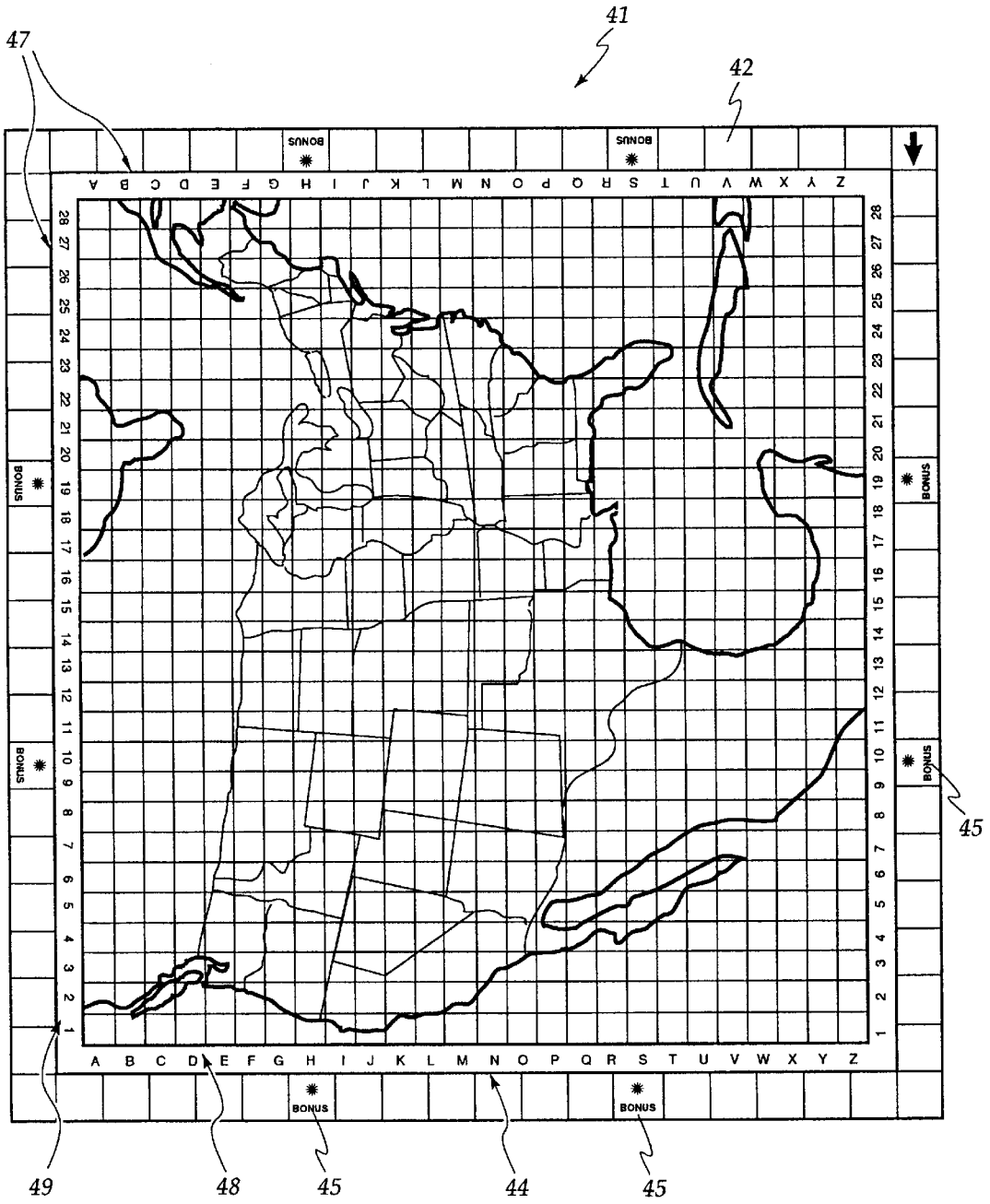
FIG. 5 illustrates another preferred embodiment in accordance with the present invention.

As can be seen in FIG. 5, the invention can be used to play a game called PINPOINT. Games board 41 has an outer periphery constituting a player progress means 42 along which a player token progresses as an indication of the stage to which a player has progressed in the game. The player progress means has a plurality of spaces including a start space 43 and a plurality of bonus question spaces 45 where a player landing on one of these spaces has the opportunity to answer a question and receive bonus points.

Game board 41 also has a grid reference system 47 comprising a plurality of alphabetical horizontal (latitudinal) grid references 48 and a plurality of numerical vertical (longitudinal) grid references 49. A map 44, in this case of the USA, is located on the games board 41. Map 44 is a high quality relief map and unlike map 22 in the embodiment of FIG. 1, does not have place names indicated thereon.

The position of various locations on the map is given by first giving the latitudinal coordinate followed by the longitudinal coordinate. Thus in FIG. 5 the position of Florida is most centrally given by positional or grid reference R22.

As seen in FIG. 6, different sets of questions 50 are provided for the map. Each question in a set of questions for a given map or the answer to each question, includes reference to a grid reference or a location on the map.

In use the rules of the game illustrated in FIGS. 5 and 6 in accordance with the invention are as follows:

PINPOINT can either be played by individual players or by teams of players.

The player or teams throwing the high scoring dice begins the game.

The player or team member throws the dice and must then answer the question with the number equivalent to that shown on the dice (the questions are provided in sets of 6).

A correct answer, ie a pinpoint in the correct square, scores three points and the player or team progresses three places around the board.

Upon answering a question correctly, the player or team is able to throw the dice again and answer another question.

Any answer where the pinpoint falls within any of the adjoining squares is awarded one point and the player or team progresses one space around the board.

If a player lands on a bonus space, they receive bonus points for correctly answering a question.

The first player or team to complete one rotation of the board wins the game.

It will be appreciated that the game provides a useful teaching method by reinforcing learning by means of emphasising the significance of each location by a grid reference which must be scrutinised to locate a position on the map. Thus in use, the teaching method of the present invention utilises the game described above by providing a game board having player progress means, providing location mapping means, providing positional reference means for providing positional references for locating positions on the location mapping means and providing question means comprising a plurality of questions, each question or the answer thereto including a reference to a positional reference of a location on the location mapping means. The learning method then plays a game such that the learners are the players, a player's progress around the player progress means being determined by how successfully the player answers the questions in the manner outlined above in relation to the board game embodiments of the invention.

It will also be appreciated that the invention may be modified to provide an effective means of promoting businesses such as food franchises and the like which have many sales outlets in distributed locations throughout an area. The game provides reinforcement of the existence and location of the branches of the business if the locations of the business are specified on the maps and at least some of the questions refer to the business or to a particular location of the business.

Thus for example if a take away fast food chain called THE GREASY SPOON had a number of outlets in the area covered by a given map, two questions making reference to this business could be as follows:

(a) What is the location of closest GREASY SPOON shop to the one at G7H5?

(b) How many GREASY SPOON shops are in the area of this map?

Similarly, Regional Tourism Authorities can provide a set of question cards and a map in accordance with the invention for the area they seek to promote as a tourist destination.

Figure 4:
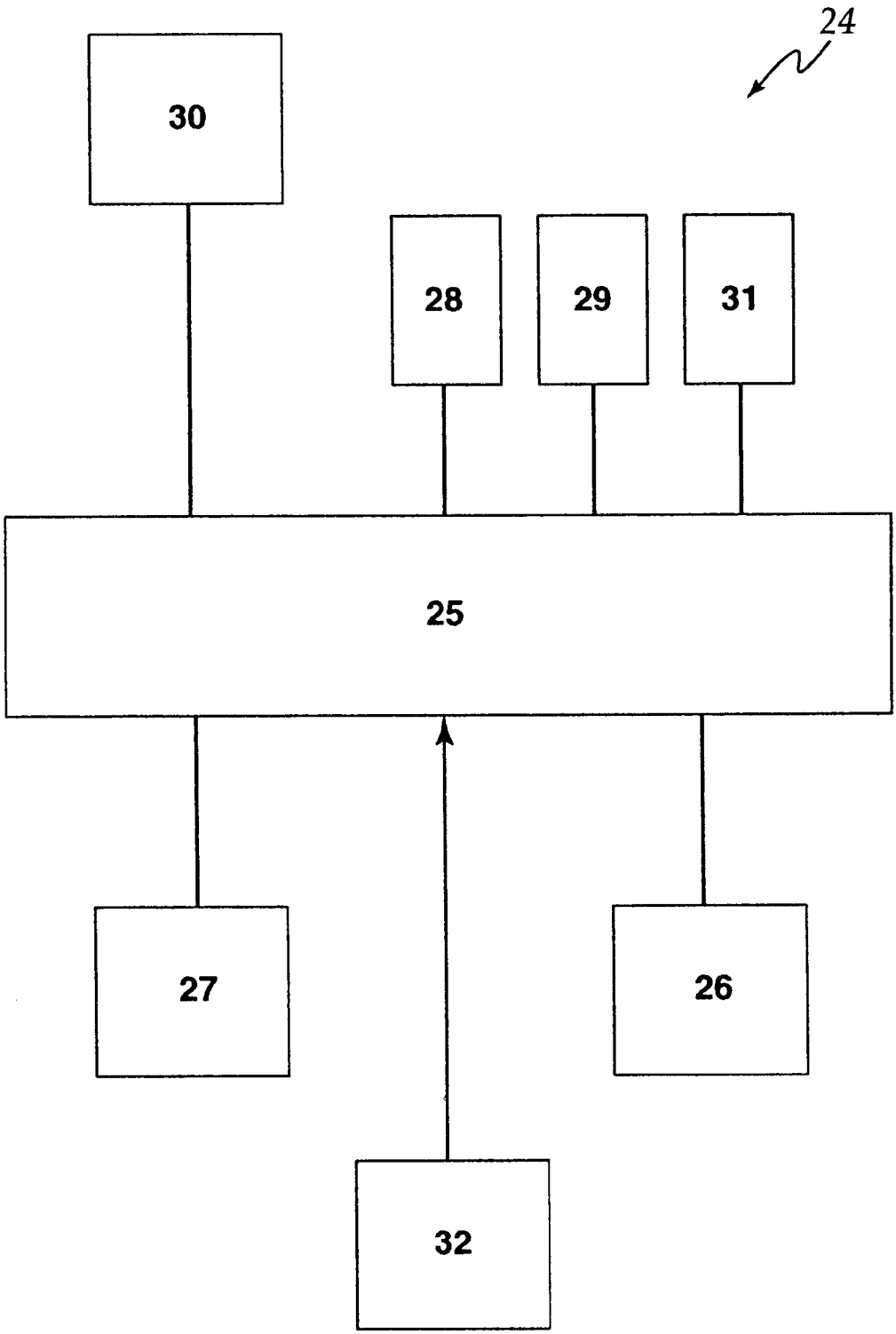
FIG. 4 is a schematic block diagram illustrating an embodiment of the invention utilising a data processing system.

As can be seen in FIG. 4, the game or teaching method or promotional method of the present invention can be played or implemented on a computer. FIG. 4 schematically illustrates a data processing system 24 in accordance with the invention having a central processing unit 25, input means 26, display means 27, game board storage means 28 for storing data representative of a game board having player progress means for display by the display means, location mapping storage means 29 for storing location mapping means, positional reference means 30 for providing positional references for locating positions on the location mapping means, and question storage means 31 for storing question means which comprise a plurality of questions with each question or the answer thereto including a reference to a positional reference of the location.

Program means 32 in the form of disc stored software controls operation of data processing system 24 whereby a player's progress around the player progress means is determined by how successfully the player answers the questions in the manner outlined above in relation to the board game embodiments of the invention.

As will be appreciated, the present invention has a number of advantages over known games, teaching methods and promotional systems. The utilisation of a positional reference on a map, thereby necessitating that participants inspect the map and locate the reference, provides positive reinforcement of the information contained in the questions and consequently the information is more likely to be remembered by the participants. This also provides an added interactive element of interest to the playing of the game, to the method of teaching or to the promotional system utilising the present invention.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

What is claimed is:

1. A game including:

a game board having player progress means;

location mapping means;

positional grid reference means for providing positional grid references for locating positions on said location mapping means, and questions means comprising a plurality of questions, each question or the answer thereto including a reference to a positional grid reference of a location on said location mapping means or to a positional reference of said location;

wherein a player's progress around said player progress means is at least partly determined by whether the player answers a question correctly, and wherein said location mapping means includes a plurality of maps of respective geographic areas.

2. A game as claimed in claim 1, wherein said plurality of maps are interchangeably positionable on said board.

3. A game as claimed in claim 1, wherein said question means includes a set of question cards, each card in the set having printed thereon a question.

4. A game as claimed in claim 3, wherein said question means includes a plurality of sets of question cards, each said set including questions relating to a given theme.

5. A game as claimed in claim 4, wherein a said plurality of sets of question cards is provided for each said map in location mapping means which comprises a plurality of maps of respective geographic areas.

6. A game as claimed in claim 3, wherein said player progress means includes question indicating means for indicating that a player can select a question card from a set thereof for answering by the player.

* * * * *